US006490818B1

(12) United States Patent
Bramhall et al.

(10) Patent No.: US 6,490,818 B1
(45) Date of Patent: Dec. 10, 2002

(54) SLIDING PICTURE FRAME

(75) Inventors: Everett Bramhall, Concord, MA (US); Steven Carroll, Brighton, MA (US); Mark Hazel, Concord, MA (US); Peter Hewitt, Concord, MA (US); Christopher Mountain, Concord, MA (US)

(73) Assignee: Bramhall & Hazel, Inc., West Concord, MA (US)

( * ) Notice: Subject to any disclaimer, the term of this patent is extended or adjusted under 35 U.S.C. 154(b) by 47 days.

(21) Appl. No.: 09/694,083

(22) Filed: Oct. 20, 2000

(51) Int. Cl.[7] ..... G09F 11/00; A47G 1/06

(52) U.S. Cl. ..... 40/491; 40/735; 40/768; 116/323

(58) Field of Search ..... 40/729, 735, 764, 40/765, 766, 767, 768, 488, 490, 491, 611; 116/321, 323

(56) References Cited

U.S. PATENT DOCUMENTS

| | | | | | |
|---|---|---|---|---|---|
| 1,835,744 | A | | 12/1931 | Austin | |
| 3,732,633 | A | | 5/1973 | Margolis et al. | |
| 3,748,767 | A | * | 7/1973 | Giesecke | 40/491 |
| 4,079,532 | A | | 3/1978 | Lyman | |
| 4,290,530 | A | | 9/1981 | Wooster | |
| 4,682,430 | A | | 7/1987 | Ramsay | |
| 4,729,183 | A | * | 3/1988 | Tarter et al. | 40/766 |
| 4,785,565 | A | * | 11/1988 | Kuffner | 40/605 |
| 4,979,324 | A | | 12/1990 | Rehtmeyer et al. | |
| 5,249,381 | A | | 10/1993 | Panossian | |
| 5,913,615 | A | | 6/1999 | Rellinger | |
| 5,987,794 | A | | 11/1999 | Lavi et al. | |
| 6,023,867 | A | | 2/2000 | Gagné | |
| 6,052,932 | A | * | 4/2000 | Reddig et al. | 40/611 |

FOREIGN PATENT DOCUMENTS

| | | | | |
|---|---|---|---|---|
| CH | 301976 | * | 11/1951 | 40/491 |

* cited by examiner

*Primary Examiner*—Brian K. Green
(74) *Attorney, Agent, or Firm*—Robert K Tendler

(57) ABSTRACT

A versatile system which includes a display unit by which a plurality of image works selected from photographs, paintings, newspaper articles, pictures, images, prints, designs, sports memorabilia, certificates, awards, and diplomas may be viewed simultaneously or individually, as selected by the viewer. A display unit stores a plurality of image works for selective viewing by an observer by virtue of each image works being mounted on a slidable carrier, which may be slid within a framework to enable or disable viewing of image works which may be disposed behind a given slidable carrier.

6 Claims, 6 Drawing Sheets

SLIDING PICTURE FRAME

FIELD OF THE INVENTION

This invention relates to aesthetic and compact means for efficiently displaying multiple image works, which image works may include, among other things, works of art and photographs. More particularly, the invention relates to a means for displaying a plurality of carriers, in which one or more of the carriers may be selectively slid to be in a position which is out of the view of the observer. The image works to be viewed are housed on the carriers.

BACKGROUND OF THE INVENTION

Various means for displaying created works such as works of literature, art, and the like, including paintings, murals, photographs, etc., have been devised over the years for the purposes of aiding the convenience of an observer desiring to view the works, and to also often add to the overall aesthetic appeal of the particular work. In the case of some artistic works, picture frames and pedestals are typical examples of such display unit. It is frequently the case that the design of a given display unit is custom-tailored to enhance or complement the specific work of which it is to assist in displaying. Thus, given the multiplicity of types of works which have been created and the various works within each type, it is of little surprise that the prior art is replete with a multitude of known means for displaying such works.

One example is U.S. Pat. No. 3,732,633 which provides a sliding panel display that includes a plurality of panels which are slidingly confined in a stepped array so as to overlap one another in a parallel orientation. In this display, each of the panels may be partially withdrawn independent relative to one another in parallel relation.

U.S. Pat. No. 4,079,532 teaches a picture display device that includes an array of picture frames hinged together, as by an endless belt, in which the inner ends of the frame sections are attached to the endless belt. The frames radiate outwardly from the belt and are arrangeable in a pair of side-by-side packs in which the frames in each pack lie flat against each other, and in which the inner frame sections of one pack abut the inner frame sections of the other pack. The device includes a support to hold the packs in side-by-side relation in a manner which permits advancement of and guides the frames from one pack to the next. The frames and the support are arranged so that advancement of a frame from the end of one pack to the beginning of the next pack causes all of the other frames in the array to advance an incremental amount.

Further, U.S. Pat. No. 4,682,430 provides an elongated price chip support strip or holder of the type utilized in menu and price display structures in fast food restaurants, which includes an elongated rectangular front panel portion that is provided along its length with a plurality of equidistantly spaced equal size price chip display openings. The front panel portion has a substantially flat front face and is provided on its rear side with a plurality of top-to-bottom extending spaced parallel ribs of equal thickness rearwardly of the front panel portion. The ribs are disposed on opposite sides of the price strip display openings, and the front panel portion is further provided in its rear side with a pair of parallel longitudinal ledges of the same thickness as the ribs rearwardly of the front panel section. The ledges define top and bottom longitudinal edges of the front panel portion.

In U.S. Pat. No. 4,979,324 a board game is provided on which the players simulate a shopping trip to a mall by moving their playing markers along a route defined by rectangles which depict stores in the mall. There are cards having decorative portions of different designs in storage areas, and each player has a frame with a plurality of cavities for receiving and depicting the decorative portions of the cards. A replica of an outfitted mannequin is formed on the front face of the frame. Several windows of transparent material are formed in the front face of the frame within the replica of the mannequin so that the decorative portions of the cards which are inserted in the frame will be visible as portions of the outfit of the mannequin.

U.S. Pat. No. 5,249,381 teaches a vehicle emergency sign which is designed to hang on a vehicle window so as to be visible to passing traffic. The sign is composed of multiple panels interconnected by sliding means which allow the sign to be retracted for convenient storage and extended to display a preprinted message. A bracket attached to a first panel has a hook portion for engaging the upper edge of a vehicle side window, and a support portion to aid in maintaining the sign in an extended position from the side of the vehicle.

Thus, a wide range of possible finished goods may be displayed using these and other means contained in the prior art. While these and many other prior art devices and methods associated with their use may have had as a common goal the display of a plurality of viewable "works" in various fashions, none has thus far provided a single device having the capability for both housing and displaying a plurality of substantially flat works, such as photographs or the like, in which a particular work may be selectively viewed by an observer while those works not being viewed are maintained in a stored position, out of view. Further, none has provided a device and means for such storage and selective display which is well-suited to either rest on a surface such as a tabletop or to be hung on a wall by conventional means. Further still, none has provided such a device and means which as a whole is itself aesthetically pleasing, and which thus enhances the overall viewing experience of the observer.

The present invention satisfies all of the aforesaid features in which the prior art falls short, by providing means for storage and selective display of the entirety of each of a plurality of substantially flat works, such as photographs and the like, which means is itself aesthetically pleasing, and lends itself well to being placed atop stationary objects such as tabletops, or to being hung on a wall or other similar location. These and other beneficial features of the invention, as well as the advantages over display units of the prior art, shall become evident to one upon reading and understanding this specification and the appended claims.

SUMMARY OF THE INVENTION

The present invention provides a widely-variable and versatile system by which a plurality of image works may be efficiently stored in a single unit and in which a given image works may also be selectively displayed by a viewer to the complete or partial exclusion of other image works contained in the unit. Accordingly, a display device provided in accordance with this invention may take on several actual physical configurations without departing from the metes and bounds of design embraced by the invention's principles.

According to one embodiment of the invention, a display unit as a whole is shaped substantially as a box or rectangular solid having a hollow inner portion and which is open on one face, and thus includes a top, a bottom, two sides, and a backing portion. The top portion is generally linear and resembles a board in one form of the invention, and has top and bottom surface portions, and first and second end portions. In a preferred embodiment, the bottom surface portion of the top portion includes a grooved channel of a selected width on its surface, so as to function as an upper track portion. The channel is preferably parallel to the length dimension of the top portion, and may in one form of the invention transverse its entire length. There is a bottom portion which has an upper surface, a lower surface, a first end portion, and a second end portion. The upper surface of the lower track portion preferably has a grooved channel on its surface, which channel is preferably parallel to the length dimension of the lower track portion and which channel is analogous to the channel on the surface of the lower surface of the upper track portion. The bottom portion thus may function as a lower track portion analogously to the top portion, by virtue of the grooved channel on the upper surface of the bottom portion.

The side portions are in one form of the invention substantially linear, and are each connectively disposed at the first end portions and second end portions of both the upper and lower track portions, respectively, to thus cause the assembly (display unit) as a whole to thus bear resemblance to a box or rectangular solid having a hollow in its interior. With a flat backing portion positioned to cover one of the faces of the geometric solid, i.e., the portion intended to be furthest away from the viewer, the resulting construction includes one open face.

The bottom surface of the upper track portion and the upper surface of the lower track portion are caused to be oriented in a substantially parallel orientation with respect to one another, which provides for slidable motion of a suitably-sized image works carrier that is confined within the grooves of the upper and lower track portions along the length dimension of the track portions, in analogous fashion to the motion of a common sliding glass patio door within its tracks. Under this arrangement it is preferable in one form of the invention for the image works carrier to exist, without limitation, in the form of a substantially flat square or rectangle which comprises parallel top and bottom edge portions of slightly less thickness than the width of the channels in the track portion, for then the top edge portion of the carrier readily resides within a channel on the bottom surface portion of the upper track portion, and the bottom edge portion of the carrier readily resides within a channel on the upper surface of the lower track portion.

The back portion covers the entire face of the rearmost part of the construction as viewed from an observer located at the open face or front of such a display unit as a whole. In one preferred form of the invention, the back portion has one or more image works mounted to it. In such an embodiment an image works which is affixed within a slidable image works carrier that disposed at its top and bottom portions within the grooved channels on the upper and lower track portions, may be positioned to block the line of sight to one or more image works which are mounted to the back portion. However, the image works carrier may be selectively moved along the length dimension of the display within the track portions by the hand of a viewer, to permit the viewing of such image works that are affixed to the back portion, and to thus render selective viewing in accordance with the principles of the invention.

These principles of variable viewing operation according to the invention may be extended to the case where the upper and lower track portions each include a plurality of adjacent parallel grooves which collectively provide for another track in which more than one image works carriers may be slidably contained, to permit a person to selectively view either an image works which is disposed on the back portion, an image works affixed in the carrier in the track nearest the viewer, or an image works affixed to a carrier that is disposed in between the track nearest the viewer and the backing portion. Such an embodiment provides a viewer with at least three choices of which image is seen at a given time, in cases when the length of the track portions are of a length equal to at least twice the width of an image works under consideration. Such an embodiment also provides an opportunity for ready comparison of a plurality of image works which are disposed side-by-side with respect to one another. A plurality of image works carriers may also be disposed beside one another within a single grooved track to dramatically increase the number of possible image works to be selectively viewed by a person in accordance with the principles of this invention.

Further extension of the principles of the invention provides an embodiment in which a top portion, which functions as an upper track portion, also simultaneously serves the common function of being the bottom portion for another display unit sharing a common leg, i.e., an embodiment wherein the top portion includes a groove on its bottom surface portion, and also includes a grooved channel on its top surface portion to enable the top surface portion or upper track of one display unit according to the invention to simultaneously serve as the bottom portion or lower track of another display unit according to the invention, in each of which display unit there are slidably housed at least one image works carrier. The principles of this invention are further extensible so that there are in fact no limit to the number of such units which may be "stacked" upon or beneath one another, the preferability of each particular embodiment being dictated by the individual user and the nature of the display contemplated. A top portion which functions as an upper track portion of one display unit according to the invention which also simultaneously serves as a bottom portion which functions as a lower track portion for another display unit according to the invention may have independently disposed about its upper and lower surfaces any number of grooved channels as are desired.

A variety of decorative woods, such as ordinary boards or boards having enhanced grains, picture frames, laminates, etc., may included to enhance the outward appearance of a display unit according to the invention being limited only by the imagination of those practicing its principles. In one preferred form of the invention, a display unit is contained within a picture frame. In another form of the invention, a display unit is contained within a decorative box which is suitable for placement on a table or stand.

BRIEF DESCRIPTION OF THE DRAWINGS

The foregoing and other objects, aspects, uses, and advantages of the present invention will be more fully appreciated as the same becomes better understood from the following detailed description of the present invention when viewed in conjunction with the accompanying drawings, in which.

DETAILED DESCRIPTION OF THE PREFERRED EMBODIMENTS

Figure 1:
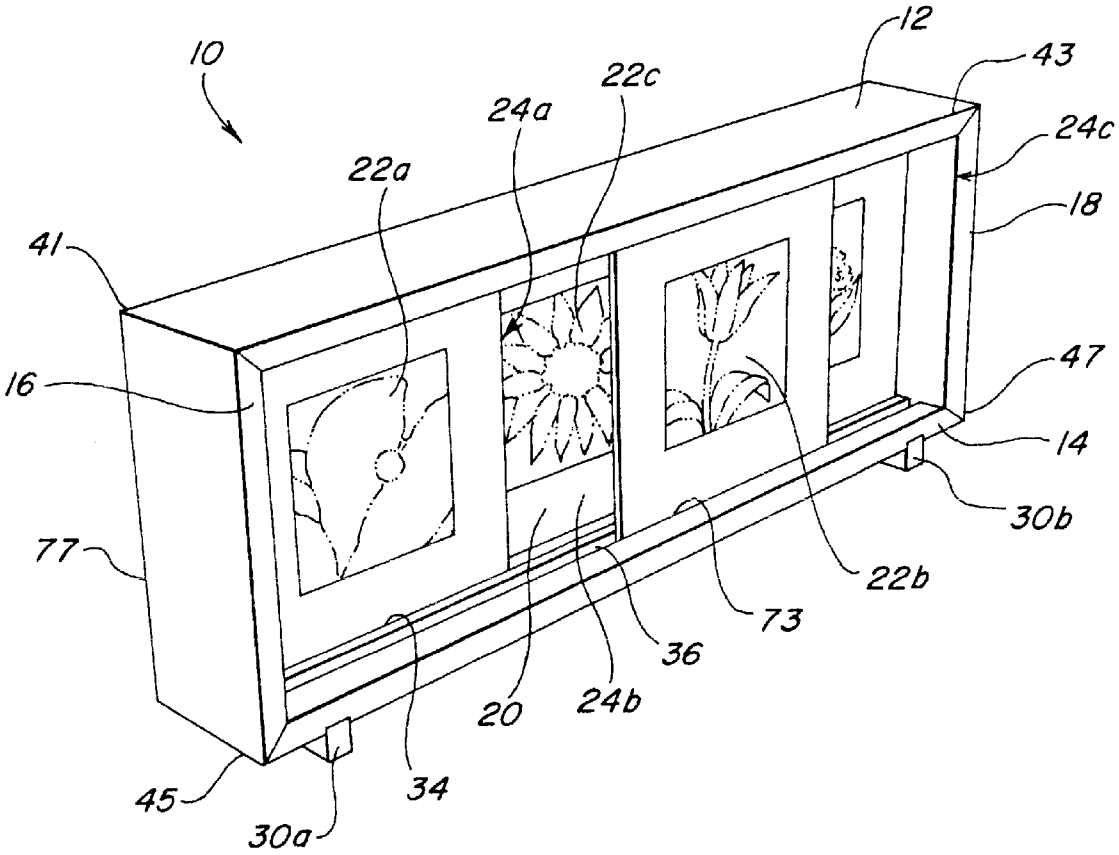
FIG. 1 is a perspective view of a display unit according to the invention.

Referring to the drawings and initially to FIG. 1 there is shown a display unit 10 provided in accordance with the invention. The display unit comprises a top portion 12 having a first end portion 41 and a second end portion 43. Disposed in a parallel fashion to the top portion is a bottom portion 14 which has a first end portion 45 and a second end portion 47. The top portion 12 and bottom portion 14 are connectively attached to one another by means of a first side portion 16 and a second side portion 18 to provide a display unit 10 which in this one preferred form of the invention takes on the shape of a rectangular solid box having a hollow portion disposed within its interior.

Disposed within the display unit 10 of FIG. 1 there are image works carriers 24*a* and 24*b*, each carrier containing an image works 22*a* and 22*b*, respectively. As used in this specification and the appended claims, the term "image works" means any substantially planar work, including without limitation works of art, pictures, paintings, photographs, images, designs, printed matter, newspaper articles, sports memorabilias, diplomas, certificates, awards, etc., with the only proviso being that such image works is capable of being mounted on an image works carrier, while maintaining the image works carrier containing such image works capable of being slidably mounted between the top portion and bottom portion of a display unit according to the invention.

The image works carriers 24*a* and 24*b* are slidably disposed within the display unit 10 of FIG. 1 between the top portion 12 and the bottom portion 14 by virtue of grooved channels disposed on the bottom surface of the top portion and the upper surface of the bottom portion, respectively. These grooved channels transverse the entire length of the top and bottom portions. In FIG. 1 there is a first channeled groove 34 on the upper surface of the bottom portion 14 of the display unit 10. There is also a second channeled groove 36 on the upper surface of the bottom portion 14 of the display unit 10. As can be seen from FIG. 1, the bottom edge of image works carrier 24*b* resides in the channeled groove 34. The second channeled groove 36 is parallel to the first channeled groove 34 and although not completely visible in FIG. 1, transverses nearly the entire length of the bottom portion 14. In this embodiment, top portion 12 also includes a plurality of grooves analogous in length, width, location, and distance from the front of the display unit as a whole as those disposed on the upper surface of bottom portion 14. Under such an arrangement, image works carrier 24*b* is slidably disposed in first channeled groove 34, image works carrier 24*a* is slidably disposed in second channeled groove 36, and stationary image works 22*c* is secured to the fixed back portion 20. For the purposes of this application, the term "fixed", when used to describe back portion 20, means that back portion 20 is not movable with respect to display unit 10 when secured therein (as shown in FIG. 1). As will be explained in greater detail herein, back portion 20 is preferably removable from display unit 10 in order to allow for replacement of images works 22*c*.

There may also be a third image works carrier 24*c* disposed within the second channeled groove 36. This arrangement provides for any of the image works which are housed on an image works carrier to be slid at the will of the user to provide selective viewing of image works which are behind any such image works carrier which is so slid.

In FIG. 1, side portion 16 includes optional door portion 77 by which a person may gain access to the ends of the channeled grooves or track portions, for purposes of removing image works carriers 24*a*, 24*b*, 24*c* and back portion 20, for purposes of cleaning, or to remove or change the image works which are contained in image works carriers 24*a*, 24*b*, 24*c* and back portion 20. Such a feature is readily provided by making either a portion of or the entire first side portion 16 easily removable from the device as a whole. In one preferred form of the invention, side portion 16 comprises a door portion 77 which includes a flat panel having tongue portions machined into its longest edge portions which are complementary to grooves in the remaining portion of side portion 16, thus providing for the door portion 77 to be removed from the device as a whole by its being lifted upwardly from the device. Alternatively, all or a part of side portion 16 may be affixed to top and bottom portions 12 & 14 by means of easily removable screws, one or more hinges, snaps, hook and eye fasteners, hook and loop fasteners or the like means, any of which are known to those skilled in the art for attaching removable side panels from constructs.

There are also preferably provided a pair of leg portions 30*a* and 30*b* which may be attached to the lower surface of bottom portion 14 for times when it is desired to rest the display unit upon a tabletop or similar surface. Such leg portions may be any material or style used by those in the art as legs on constructs intended to rest upon tabletops or similar surfaces.

Although the principal means for providing slidable motion of an image works carrier in the context of the invention has been described as comprising a channeled groove on the surfaces of the top and bottom portions, all functional equivalents in this regard known to those skilled in the art are herein indicated as being employable within the metes and bounds of the invention, including, rails, tracks, guides, and including the use of image works carriers having bearings or wheels disposed on their top and/or bottom edge portions. It is really of little practical consequence respecting the overall function of a device according to the invention whether the track portions comprise channeled grooves or some other means for providing slidable motion of an image works carrier as herein described. The means for providing slidable motion may comprise channeled grooves machined into the surface of a top or bottom portion to a desired depth, using for example, a router or similar tooling. However, distinct tracks which may be affixed by glue, fasteners or the like to say, the upper surface portion of the bottom portion may be used as well. It is most preferred however, that the means for providing slidable motion are channeled grooves machined into the surfaces of the top and bottom portions. A pair of tracks suitable for providing sliding motion of an image works carrier within a display unit according to the invention shall be referred to as a "track means" herein.

Figure 2:
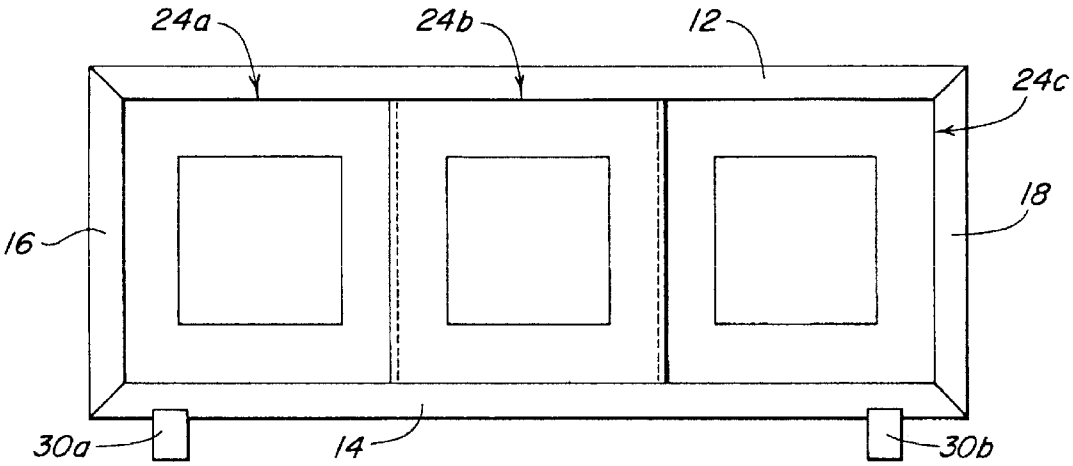
FIG. 2 is a front view of a display unit of FIG. 1.

In FIG. 2 is shown the relationships between top portion 12, bottom portion 14 and its leg portions 30*a* and 30*b*, first end portion 16, second end portion 18, and image works carriers 24*a*, 24*b*, and 24*c*.

Figure 3:
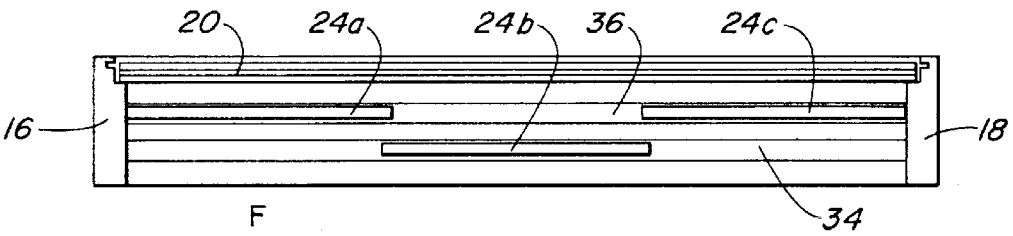
FIG. 3 is an overhead cutaway view of the device of FIG. 2.

FIG. 3 is an overhead cutaway view which shows the respective positions of image works carriers 24*a*, 24*b*, and 24*c* with respect to the backing portion 20 and the front F of the display unit. In this figure, image works carrier 24*b* is shown to reside in the first grooved channel, while image works carriers 24*a* and 24*c* are shown to reside in second channeled groove 36.

Figure 4:
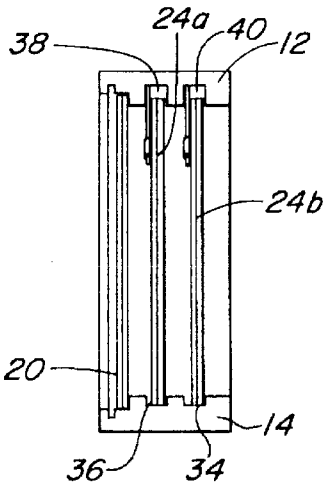
FIG. 4 is a side cutaway view of the device of FIGS. 2 & 3.

In FIG. 4 is shown a side cutaway view to depict the respective positions of back portion 20, image works carrier 24*a* disposed in channeled grooves 36 and 38, and 24*b* disposed in channeled grooves 34 and 40. Also shown is the top portion 12 and the bottom portion 14, and back portion 20.

Figure 5:
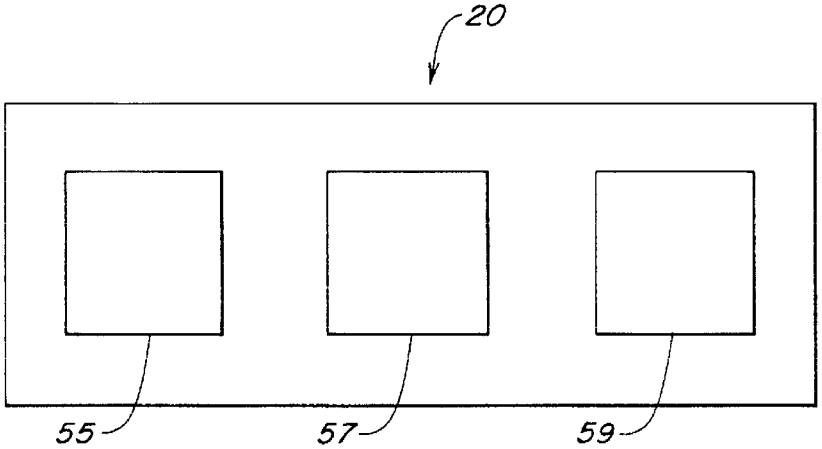
FIG. 5 is a front view of a backing portion according to the invention.

FIG. 5 is a front view of a backing portion 20 useful in accordance with the invention having in this embodiment accommodations for three different image works, which accommodations are windows within a matting.

Figure 6A:
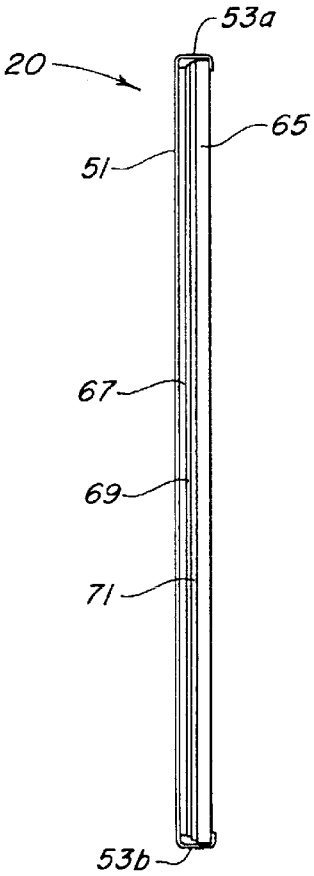
FIG. 6A is an end view of a backing portion according to the invention.

FIG. 6A is an end view of a backing portion 20 from FIG. 5 according to a preferred form of the present invention, from which it can be seen that in this preferred embodiment the backing portion is comprised of a stamped indent detail 51 which is preferably a stamped steel sheet which has been bent at 90 degree angles at its upper end portion 53*a* and lower end portion 53*b*, and further again bent at about an angle of 90 degrees very near each of these end portions to form an upper hooking lip portion 63*a* and a lower hooking lip portion 63*b*. Such arrangement permits a user to slide in or out of the confines of backing portion 20 a desired image works which may include a backing, matting, etc. disposed about them. In one preferred form of the invention, for example, there is disposed a backing sheet 67 upon which is a photograph 69, and around which photograph is a paper mat 71. To prepare such an arrangement, backing sheet 67 conforming substantially to the dimensions of backing portion 20 is laid out. Atop backing portion 20 are laid photographs 69, and atop backing portion 20 and around photographs 69 is next laid paper mat 71. In this embodiment, paper mat 71 includes three (3) openings 55, 57, and 59 through which image works can be viewed. As will become evident through the description herein of other embodiments of the present invention, many different configurations of image work openings 55, 57 and 59 are possible. Finally, atop this whole composite is laid an acrylic sheet 65 that conforms substantially to the dimensions of backing portion 20. The user holds these various elements together and then slides these layers into the stamped indent detail. By selecting the materials which form the composite of the proper thickness, a snug fit of the elements of the composite within the stamped indent detail is readily achieved, which is especially well suited to serve as a backing portion 20 in a display unit according to the invention.

The backing portion 20 may be affixed to the rear portion of a display unit according to the invention using any means known for attaching planar substrates to other surfaces. Such means may include fasteners known to those skilled in the art such as nails, screws, hook and eye fasteners, glues, hook-and-loop type fasteners, or hinged tangs which are commonly used on picture frames to hold the back portion in place, when the picture frame is constructed to include an indentation conforming in dimension to the backing portion. The present invention includes within its scope all such means for affixing its back portion to the display unit, including necessary modifications recognized by those skilled in the art for implementing such means for affixing a back portion.

Figure 6C:
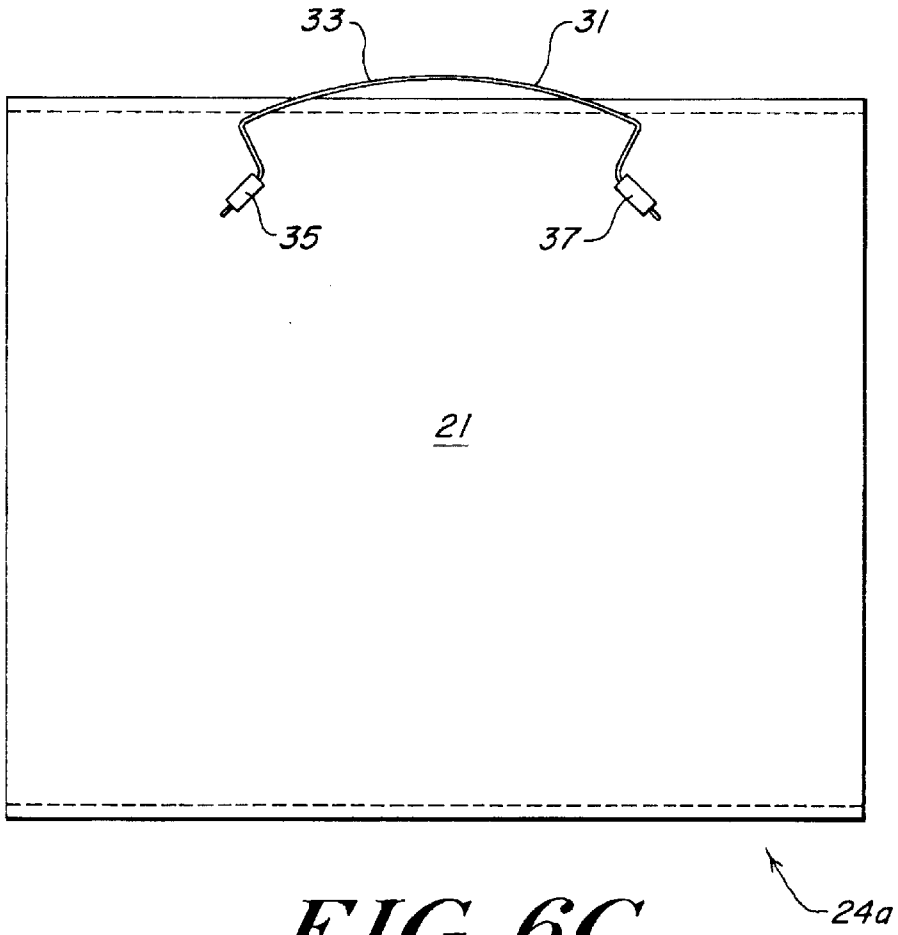
FIG. 6C is a rear view of an image works carrier according to the invention.
Figure 6B:
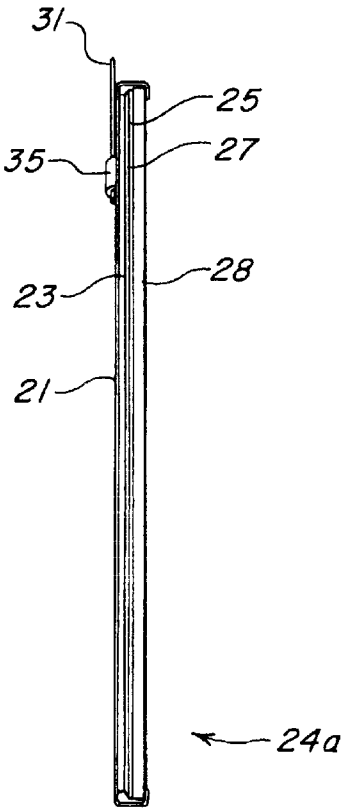
FIG. 6B is an end view of an image works carrier according to the invention.

FIGS. 6B & 6C show an end view and a rear view, respectively, of image works carrier 24*a*, image works carriers 24*b* and 24*c* being substantially identical thereto. As FIGS. 6B and 6C disclose, image works carrier 24*a* is nearly identical in structure to backing portion 20, including stamped indent detail 21, backing sheet 23, photograph 25, paper mat 27, and acrylic sheet 29.

Image works carrier 24*a* may optionally include a retention spring 31 having a center portion 33 and being affixed to the rear side of stamped indent 21 by two fasteners 35, 37. Spring 31 is designed to flex when inserted into fasteners 35, 37, upwardly bowing center portion 33 so that it protrudes upwardly from image carrier 24*a*. Spring 31 serves two functions: (1) it allows image works carrier 24*a* to be removed from display unit 10 by forcing image works carrier 24*a* upwardly into channeled groove 38 or 40 which releases image works carrier 24*a* from channeled groove 36 or 34, respectively, and allows the lower portion of image works carrier 24*a* to be tiled away from backing portion 20; (2) it wedges image works carrier 24*a* between grooves 38 and 36 or 40 and 34 to prevent carrier 24*a* from sliding longitudinally along the grooves when display unit 10 is moved. Spring 31 provides an alternative means for removing image works carrier 24*a* from display unit 10 and replacing it therein. Thus, door portion 77 may be omitted from embodiments of the present invention in which image works carrier 24*a* includes spring 31. In an embodiment where door portion 77 is omitted, a conventional removable picture frame backing (not shown) is preferably included to enable removal of backing portion 20.

Figure 7:
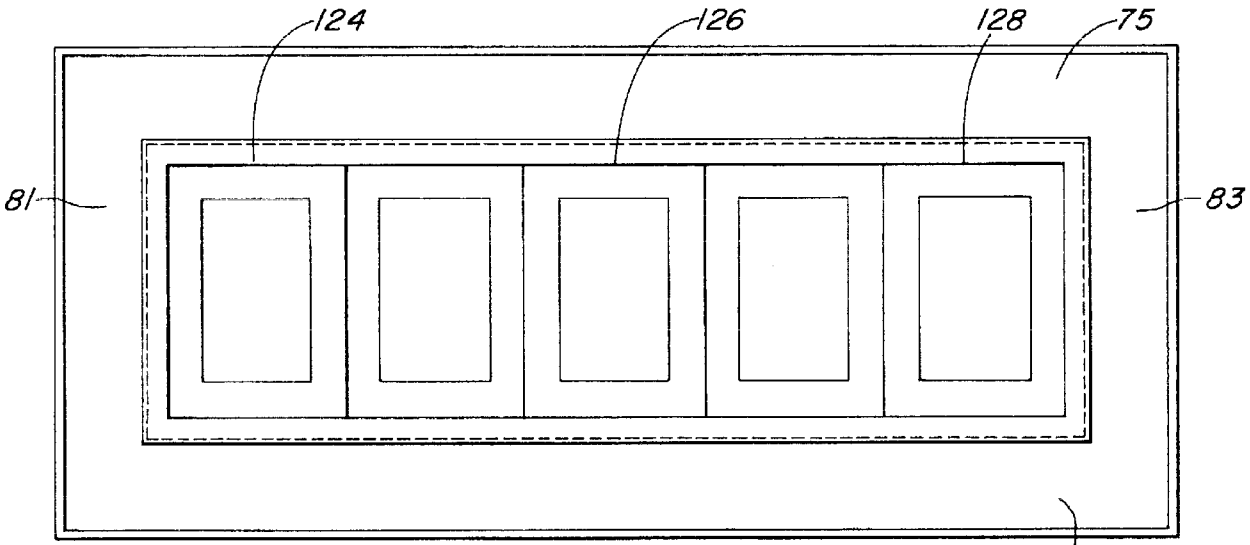
FIG. 7 is a front view of a display unit according to an alternative form of the invention.

In FIG. 7 is shown a front view of a display unit according to an alternative form of the present invention in which a display unit includes a backing portion which accommodates five (5) individual image works. This embodiment is analogous to those already described and is included herein to exemplify the versatility of the present invention with respect to the number of image works which may be displayed and to also show the variance in the way such numbers of image works may be presented. In FIG. 7, the image display unit is shown having a picture frame disposed about its top portion, bottom portion and first and second end portions, and this embodiment thus lends itself well to being hung on a wall for display, especially owing to the aesthetic contribution of the frame portion when properly selected. In FIG. 7 are shown a top frame portion 75, a bottom frame portion 79, a first frame side portion 81, and a second frame side portion 83. Also, three image works carriers 124, 126, and 128 are shown.

Figure 8:
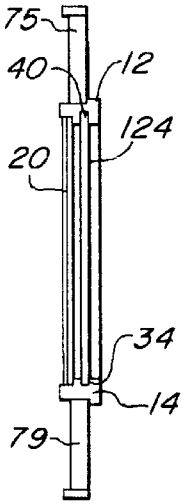
FIG. 8 is an end cutaway view of the arrangement of the inner elements of the display unit according to the alternative form of the invention of FIG. 7.

FIG. 8 is an end cutaway view of the arrangement of the inner elements of a display unit according to the embodiment of the invention depicted in FIG. 7 showing top portion 12, bottom portion 14, backing portion 20 and image works carrier 124 disposed within channeled grooves 34 and 40. Also shown is top frame portion 75 and bottom frame portion 79.

The frame portion may be affixed about the top, bottom, and end portions of a display unit according to the invention using any means known for attaching outer decorative or functional frame assemblies to other surfaces, including constructions used in producing picture frames. Such means may include fasteners known to those skilled in the art such as nails, screws, hook and eye fasteners, glues, hook and loop type fasteners. The present invention includes within its scope all such means for affixing such a frame portion about the elements of the display unit, including any modifications necessary as recognized by those skilled in the art for affixing a frame to a construct.

Figure 9:
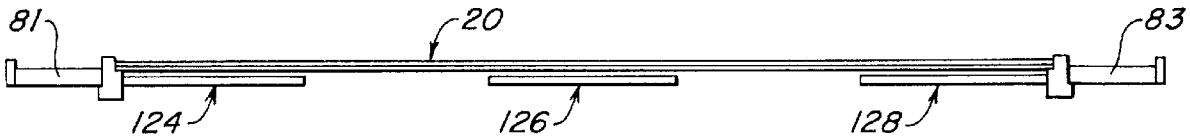
FIG. 9 is a top cutaway view of the arrangement of the inner elements of the display unit according FIGS. 7 & 8.

FIG. 9 is a top cutaway view of the arrangement of the inner elements of a display unit according to the embodiment of the invention depicted in FIG. 7 showing image works carriers 124, 126, and 128, backing portion 20, and first and second frame side portions 81 and 83.

Figure 10:
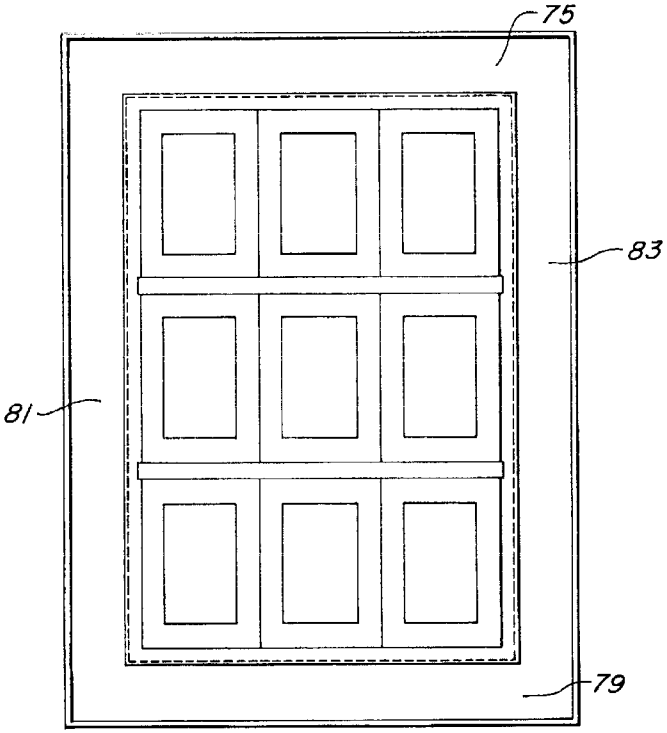
FIG. 10 is a front view of a display unit according to another alternative form of the invention.

In FIG. 10 is shown a front perspective view of a display unit according to yet another alternative form of the present invention in which a display unit includes a backing portion which may accommodate nine (9) individual image works. Such an embodiment is analogous in many ways to those already described and is presented herein to exemplify the versatility of the present invention with respect to the number of image works which may be displayed and to also show the variance in the way such numbers of image works may be presented. In this figure, the image display unit is shown having a picture frame disposed about its top portion, bottom portion and first and second end portions, and such embodiment may thus lend itself well to being hung on a wall for display, especially owing to the potential aesthetic contribution of the frame portion when properly selected. In FIG. 10 are shown top frame portion 75, bottom frame portion 79, first frame side portion 81, and second frame side portion 83. Also, there are a plurality of image works carriers disposed within the inner volume of the display unit.

Figure 11:
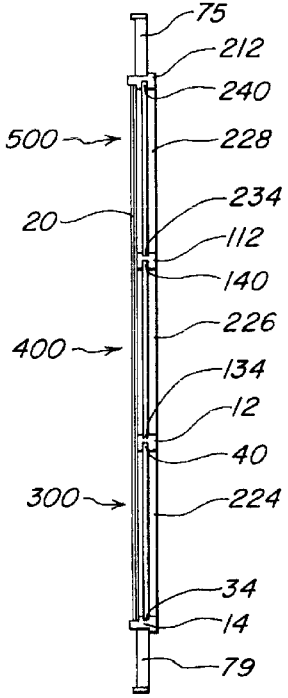
FIG. 11 is an end cutaway view of the arrangement of the inner elements of the display unit of FIG. 10.

FIG. 11 is an end cutaway view of the arrangement of the inner elements of a display unit according to the alternative form of the invention depicted in FIG. 10 showing top portion 12, bottom portion 14, backing portion 20 and image works carrier 224 slidably disposed within the channeled grooves 34 and 40. However, provision is also made in this embodiment for image works carriers 226 and 228 to be disposed within additional display unit units which may be considered as being "stacked" atop a first given display unit. This is accomplished by having a top portion 12 of a display unit according to the invention that serves as the upper track portion of the image works carrier 224 to simultaneously serve as the lower track portion of another display unit disposed immediately above the first unit, which is in turn accomplished by providing the top portion with a channeled groove 134 on its upper surface portion in addition to the channeled groove disposed on its bottom surface portion 40. This principle is further extensible, without limitation, to include more display units similarly vertically stacked, for example by having the top portion 112 of a second display unit 400 which itself is vertically stacked atop a first display unit 300 also include a channeled groove on its top surface portion 234 which simultaneously may serve as the bottom portion of a third display unit 500 according to the invention.

Also shown in FIG. 11 are top frame portion 75 and bottom frame portion 79 disposed about the display unit according to the invention, which frame portion may be constructed and disposed about such display unit analogously to such means as described in FIGS. 7, 8, and 9.

Figure 12:
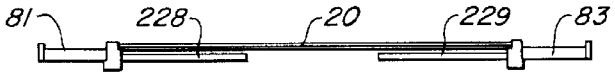
FIG. 12 is a top cutaway view of the arrangement of the inner elements of the display unit of FIGS. 10 & 11.

FIG. 12 is a top cutaway view of the arrangement of the inner elements of a display unit according to the alternative form of the invention depicted in FIG. 10 showing image works carriers 228 and 229, backing portion 20, and first and second frame side portions 81 and 83.

Thus it is readily apparent from the above that the present invention may take on a wide variety of configurations. For example, the number of image works carriers disposed within a given track is limited only by the width of the display unit as a whole and the widths of the individual image works carriers. Further, the number of display units which may be stacked atop one another is also boundless, as it is possible to continue to stack display units atop one another indefinitely. Therefore, the user of the principles embraced by the present invention has at their disposal many possibilities when selecting a configuration for a given set of circumstances. A display unit according to the invention may thus contain, without limitation, as few as one image works carriers disposed in its sole grooved track, or it may comprise three image works carriers disposed in one of two tracks of a unit, which then has two more display unit units stacked about its top portion, each of which may comprise one or more tracks and contain any desired number of image works carriers disposed in them.

Various references have been made herein to an image works carrier, as it is this element to which an image works that is intended to be viewed in accordance with the invention is made an integral part. An image works carrier in its simplest form may be a piece of flat construction, such as cardboard, a sheet of plywood, a sheet of acrylic polymer, etc., as its function is to slidably reside within the channeled grooves or other track portions employed in the invention. A particular image works may be affixed to an image works carrier by such simple means as thumbtacks, adhesives, tape, glues, staples, etc. Thus, an image works carrier may take on a wide variety of forms. However, it is most preferred that an image works that is housed in an image works carrier be shielded from ambient conditions, and the construction described above for the backing portion 20 is especially preferred for such use, as it is possible to employ a stamped indent detail 51 having a backing sheet with the image works disposed on the backing sheet and having a paper mat disposed about the image works, with a clear sheet of polyacrylate or other clear polymer over the face of the whole composite. Although such construction is preferred in one form of the invention, the scope of this invention is not limited to this embodiment, and any planar surface which fits within the track portions of a display unit according to the invention and upon which an image works may be affixed is useful as an image works carrier for purposes of the invention. In yet another preferred form of the invention, an image works carrier comprises a picture frame.

Consideration must also be given to the fact that although this invention has been shown and described with respect to certain preferred embodiments, it shall become obvious to one of ordinary skill after reading this specification and the appended claims that equivalent or functionally-equivalent alterations and modifications to this invention are possible. The present invention includes all such equivalent or functionally-equivalent alterations and modifications, and is limited only by the scope of the claims which now follow.

We claim as our invention:

1. An apparatus for displaying a plurality of image works, comprising:

a frame having a top portion and a bottom portion, said top portion having an upper surface and a lower surface, said lower surface including a first track means that is parallel to the length dimension of said top portion, said bottom portion having an upper surface and a lower surface, said upper surface including a second track means that is parallel to the length dimension of said bottom portion;

a backing portion having at least one image works therein and being fixed relative to said frame;

a first image works holder, said first holder including top and bottom edges, wherein said top edges of said first holder is cooperatively engaged with said first track means, and wherein said bottom of said first holder is cooperatively engaged with said second track means, such that said first holder is slidably disposed within said frame so as to alternately expose image works for viewing.

2. The apparatus of claim 1, wherein each of said first and second track means comprises a channeled groove.

3. The apparatus of claim 2, further comprising a second image works holder including top and bottom edges, said top edge of said second holder being cooperatively engaged with said first track means, said bottom edge of said second holder being cooperatively engaged with said second track means, so that said second holder is slidably disposed within said frame.

4. The apparatus of claim 3, wherein said lower surface of said top portion further includes a third track means that is parallel to said first track means, said upper surface of said bottom portion further including a fourth track means that is parallel to said second track means, and a third image works holder including top and bottom edges, said top edge of said third holder being cooperatively engaged with said third track means, said bottom edge of said third holder being cooperatively engaged with said fourth track means, so that said third holder is slidably disposed within said frame.

5. The apparatus of claim 4, wherein said top portion of said frame further comprises a first end portion, and a second end portion and said bottom portion of said frame further comprises a first end portion, and a second end portion, and said frame further comprises a first side portion connectively disposed at said first end portions of both said top portion and said bottom portion, and a second side portion connectively disposed at said second end portions of both said top portion and said bottom portion, such that said bottom surface portion of said top portion and said upper surface of said bottom portion are oriented substantially parallel to one another.

6. An image works display unit comprising:

a frame having a front side and a rear side;

a first backing portion fixed in said frame carrying first, second and third image works therein;

first, second and third image holders located between said first backing portion and said front side of said frame, said first holder being adapted to carry a fourth image works, said second holder being adapted to carry a sixth image works; and means for permitting moving said first, second and third holders relative to said first backing portion so as to alternately expose three of said first, second, third, fourth, fifth and sixth image works for viewing.

* * * * *